US008616251B2

(12) United States Patent
Sutcliffe et al.

(10) Patent No.: US 8,616,251 B2
(45) Date of Patent: Dec. 31, 2013

(54) BREAKAWAY FUEL HOSE CUP

(75) Inventors: Grenville G. Sutcliffe, Pacific, MO (US); John C. Sever, Pacific, MO (US)

(73) Assignee: Husky Corporation, Pacific, MO (US)

( * ) Notice: Subject to any disclaimer, the term of this patent is extended or adjusted under 35 U.S.C. 154(b) by 523 days.

(21) Appl. No.: 12/927,174

(22) Filed: Nov. 9, 2010

(65) Prior Publication Data

US 2011/0114221 A1 May 19, 2011

Related U.S. Application Data

(60) Provisional application No. 61/281,458, filed on Nov. 18, 2009.

(51) Int. Cl.
*B65D 1/34* (2006.01)

(52) U.S. Cl.
USPC ..... 141/86; 141/98; 141/311 A; 220/571

(58) Field of Classification Search
USPC ..... 141/85–87, 98, 311 A, 392; 220/571, 220/573
See application file for complete search history.

(56) References Cited

U.S. PATENT DOCUMENTS

| | | | | | |
|---|---|---|---|---|---|
| 4,013,105 | A | * | 3/1977 | Uuskallio | 141/86 |
| 4,099,654 | A | * | 7/1978 | Antolino | 222/184 |
| 4,149,575 | A | * | 4/1979 | Fisher | 141/98 |
| 4,520,852 | A | * | 6/1985 | Klein | 141/86 |
| 4,659,251 | A | * | 4/1987 | Petter et al. | 405/52 |
| 5,058,633 | A | * | 10/1991 | Sharp | 141/86 |
| 5,067,530 | A | * | 11/1991 | Short, III | 141/98 |
| 5,339,676 | A | * | 8/1994 | Johnson | 73/40 |
| 5,477,897 | A | * | 12/1995 | Scofield | 141/105 |
| 5,785,329 | A | * | 7/1998 | Stanley | 280/79.5 |
| 6,182,695 | B1 | | 2/2001 | Coates, III et al. | |
| 6,192,934 | B1 | | 2/2001 | Coates, III et al. | |
| 6,840,293 | B1 | * | 1/2005 | Smith | 141/86 |
| 8,016,150 | B1 | * | 9/2011 | Bunch et al. | 220/571 |

* cited by examiner

*Primary Examiner* — Gregory Huson
*Assistant Examiner* — Nicolas A Arnett
(74) *Attorney, Agent, or Firm* — Paul M. Denk

(57) ABSTRACT

A cup for draining residual fuel from a breakaway hose coupling. The cup features a substantially cylindrical rigid stem extending upward from the floor of the cup reservoir, said stem featuring a cavity for receiving the pin of a breakaway hose valve. When the stem is pressed against the valve pin, the valve is opened, relieving pressure within the hose and releasing residual fuel within the hose. The residual fuel drains directly from the hose into the cup, facilitating safe and convenient disposal of the fuel, which may be poured using an integral pour spout in the cup rim.

4 Claims, 1 Drawing Sheet

BREAKAWAY FUEL HOSE CUP

CROSS REFERENCE TO RELATED APPLICATION

This non provisional patent application claims priority to the provisional patent application having Ser. No. 61/281,458, having filing date Nov. 18, 2009.

BACKGROUND OF THE INVENTION

Breakaway hose couplings have become a standard feature on filling station fuel pumps. A breakaway coupling prevents damage that would otherwise result from a customer driving away from a fuel pump without first removing the nozzle of the pump from his automobile fuel tank. Even on a hose equipped with a breakaway coupling, however, there is a measure of inconvenience and hazard involved with recoupling the hose. Prior to recoupling, the vapor pressure in the hose must be relieved, and the residual fuel in the hose must be drained. Examples of breakaway hose couplings can be seen in the various patents to the inventors' assignee, Husky Corporation, as set forth in U.S. Pat. No. 6,182,695 and U.S. Pat. No. 6,192,934. These are the type of breakaway couplings to which this fuel cup has applicability when being used for the process of this invention.

SUMMARY OF THE INVENTION

The present invention greatly simplifies the process of preparing a fuel hose for re-coupling after detachment. In a breakaway coupling with a valve pin, the valve pin in the hanging side of the coupling must be depressed in order to open the valve. This requires an exertion of force against the end of the valve pin. This force must be maintained for the valve pin to remain open for the release of pressure and the draining of residual fuel from the hanging portion of the hose. The present invention provides a means for opening the valve in a breakaway coupling, relieving vapor pressure, and collecting residual fuel in a single step.

In the preferred embodiment, the present invention provides a cup made of molded polymer with a circular base. The cup features an integral, substantially cylindrical rigid stem extending upward from the center of the floor of the cup reservoir, substantially perpendicular to said floor. The rigid stem features a pin receptor in its upper extreme. The receptor is a cavity substantially in the shape of an inverted cone. The cup further features an integral pour spout in its rim. In another embodiment, the cup may also feature at least one integral handle.

To use the cup, the technician inserts the stem of the cup into the breakaway valve and places the pin receptor over the hose valve pin. Holding the cup in a substantially upright position, the technician then presses the stem against the valve pin, causing the valve to open. The cup and pin are maintained in this relationship while the vapor pressure is released from the hose and the residual fuel drains therefrom into the cup reservoir. After the residual fuel is collected, it may be poured into an appropriate container via the pour spout in the rim of the cup.

It is an object of this invention to provide a tool for depressing a valve pin to open the valve of a breakaway fuel hose coupling. It is a further object of this invention to provide a cup for collection of residual fuel from a breakaway fuel hose, the cup being equipped to simultaneously hold open the valve and collect residual fuel.

Other objects may be considered by those skilled in the art upon reviewing of the subject matter of this invention, as explained in this summary.

DESCRIPTION OF THE PREFERRED EMBODIMENT

Figure 1:
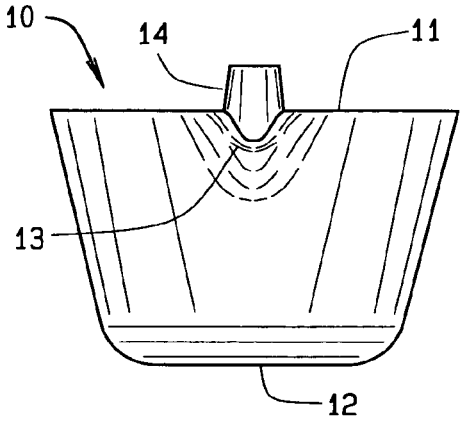
FIG. 1 is a side elevational view of the fuel cup, showing the spout and the uppermost portion of the stem.

This description is of the preferred embodiment of the fuel cup as represented in the drawings. Referring to FIG. 1, there is shown a side elevation of a fuel cup 10 with rim 11 and base 12. Pour spout 13 can be seen as an extension of rim 11. Rigid stem 14 is shown extending above rim 11 of the cup.

Figure 2:
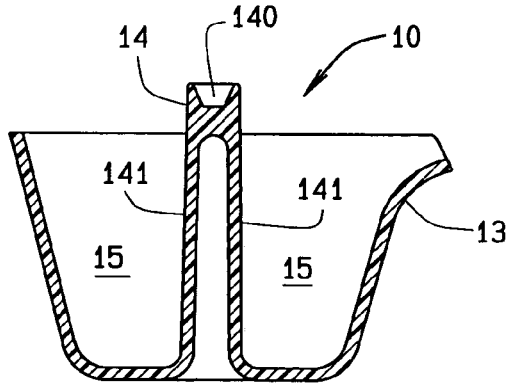
FIG. 2 is a side cross-section view of the fuel cup, showing the stem in the center of the reservoir and the spout in the rim of the cup.

Referring to FIG. 2, there is shown a cross-sectional side elevation of fuel cup 10 with pour spout 13, rigid stem 14, and reservoir 15. Pin receptor 140 is shown circled by a broken line in the center of the uppermost portion of rigid stem 14. As can be seen, pin receptor 140 is substantially in the shape of an inverted cone. In this embodiment, the rigid stem is hollow throughout the majority of its length and is formed integrally with the remainder of the cup. As can be seen and understood, the vertical wall 141 of the stem 14 is contiguous with the floor of reservoir 15. In the preferred embodiment, stem 14 is tapered slightly so that its diameter is greater at its base than at its uppermost extent.

Figure 3:
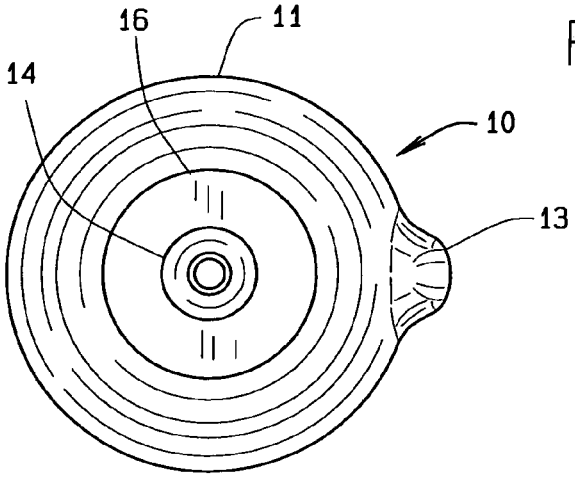
FIG. 3 is a bottom view of the fuel cup.

Referring to FIG. 3, there is shown a bottom of cup 10 spout 13, rim 11, and rigid stem 14. The wall of the reservoir transitions at 16 to the floor of the reservoir.

Figure 4:
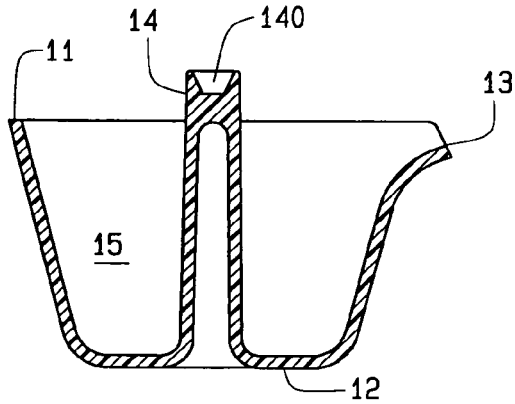
FIG. 4 is a cross-sectional side elevation of the fuel cup.

Referring to FIG. 4, there is shown a cross-sectional side elevation of fuel cup 10 with rim 11, base 12, pour spout 13, rigid stem 14 with pin receptor 140, and reservoir 15.

Variations or modifications to the subject matter of this invention may occur to those skilled in the art upon review of the disclosure as provided herein. Such variations, if within the scope of this disclosure, are intended to be encompassed within the spirit of the invention as defined. The description of the preferred embodiment, and the depiction of the invention in the drawings, is done so for illustrative purposes only.

We claim:

1. A cup for draining residual fuel from a breakaway hose coupling, of the type incorporating a valve pin, said cup comprising a reservoir, said reservoir having a base, and said reservoir having an integral rigid stem extending upwardly from said base of the reservoir, said rigid stem having a height greater than the height of said cup, and said stem capable of engagement with the valve pin of the breakaway hose coupling to provide for drainage of its residual retained fuel.

2. The cup of claim 1 wherein said rigid stem incorporating at its uppermost extremity a pin receptor cavity for receiving a valve pin of said hose coupling.

3. The cup of claim 1 wherein said stem extends centrally upwardly within the said cup.

4. The cup of claim 1 wherein said cup includes an integral pour spout to facilitate pouring of any collected residual fuel.

* * * * *